US007935007B1

(12) United States Patent
Gawryla

(10) Patent No.: US 7,935,007 B1
(45) Date of Patent: May 3, 2011

(54) TURF ACCESSORY PLACEMENT DEVICE

(76) Inventor: Christopher Andrew Gawryla, Port Matilda, PA (US)

( * ) Notice: Subject to any disclaimer, the term of this patent is extended or adjusted under 35 U.S.C. 154(b) by 46 days.

(21) Appl. No.: 12/135,147

(22) Filed: Jun. 7, 2008

(51) Int. Cl.

| | |
|---|---|
| ***A01B 1/00*** | (2006.01) |
| ***A01B 45/00*** | (2006.01) |
| ***A01B 45/02*** | (2006.01) |
| ***A63B 69/00*** | (2006.01) |
| ***A63B 71/00*** | (2006.01) |

(52) U.S. Cl. ..... 473/452; 473/497; 473/499; 172/21; 172/379; 172/381

(58) Field of Classification Search ..... 172/21, 172/379, 378, 381, 371; 473/218, 415, 451, 473/452, 497, 499; D21/780
See application file for complete search history.

(56) References Cited

U.S. PATENT DOCUMENTS

| | | | | |
|---|---|---|---|---|
| 1,709,041 | A * | 4/1929 | Schutt | 40/536 |
| 2,020,571 | A * | 11/1935 | Pick | 172/21 |
| 3,489,411 | A * | 1/1970 | Morelli et al. | 473/417 |
| 2009/0270206 | A1 * | 10/2009 | Massaro | 473/497 |

FOREIGN PATENT DOCUMENTS

GB 2113993 A * 8/1983

* cited by examiner

*Primary Examiner* — Christopher J. Novosad
(74) *Attorney, Agent, or Firm* — John J. Elnitski, Jr.

(57) ABSTRACT

A turf accessory placement device adapted for use with turf. The turf accessory placement device has a base. The base has a top, bottom and sides between the top and bottom. The turf accessory placement device has grip spikes extending from the bottom of the base which are adapted to grip the turf. The grip spikes have spike shanks projecting from the base in the same direction at an angle between one degree and eighty-eight degrees downward from a plane along the bottom of the base.

12 Claims, 4 Drawing Sheets

TURF ACCESSORY PLACEMENT DEVICE

BACKGROUND

The present invention generally relates to items used with turf surfaces. More specifically, the present invention relates to a device used with artificial turf surfaces to allow positioning of items or allow the use of lines to aid in marking of the artificial turf surface.

Currently, improved artificial turf surfaces more closely simulate grass surfaces. Today's improved artificial turf surfaces are sometimes referred to as field turf. Field turf includes a simulated grass layer, which is placed over a padded concrete layer or padded stone layer. The simulated grass layer is made up of two components. The first component is a multitude of plastic blades which simulate blades of grass. The second component is a weave layer. The plastic blades are woven into the weave layer to form a sort of carpet of simulated grass. Rubber particles are then worked in between the plastic blades. Together, the rubber particles and the padding on either the concrete or stone simulate the soil normally found under natural grass.

Even though, the rubber particles simulate a layer of soil in the simulated grass layer, the rubber particles do not have the same properties as soil. The rubber particles can not be compacted to form a solid layer, as soil becomes compacted over time under grass. Sharp implements such as a nail, spike or stake are used to hold something to the grass or hold a string which can be used to paint straight lines on the grass. When a sharp implement is driven into grass, the soil parts and compacts around the implement. The way the soil reacts to the implement, usually allows for the implement to be held in place. The blades of grass are separate entities which are pushed aside by the implement. There is usually hardly any damage to the blades of grass, when such an implement is driven into the soil under the grass. Driving such an implement into today's field turf is another matter. First of all, the rubber particles act differently around the implement. The rubber particles do not compact around the implement and hold the implement in place. The current implements impale through the weave layer of the simulated grass layer. When the implement impales the weave layer, the implement damages the weave layer of the simulated grass layer, especially since the rubber particles do not securely hold the implement in place. This damage causes premature wear to the field turf. What is needed is an implement that can engage the field turf without impaling the weave layer of the simulated grass layer.

It is an object of the present invention to provide a device which can be secured to artificial turf without damaging the artificial turf.

SUMMARY OF THE INVENTION

A turf accessory placement device adapted for use with turf. The turf accessory placement device has a base. The base has a top, bottom and sides between the top and bottom. The turf accessory placement device has grip spikes extending from the bottom of the base which are adapted to grip the turf. The grip spikes have spike shanks projecting from the base in the same direction at an angle between one degree and eighty-eight degrees downward from a plane along the bottom of the base.

DETAILED DESCRIPTION

Figure 1:
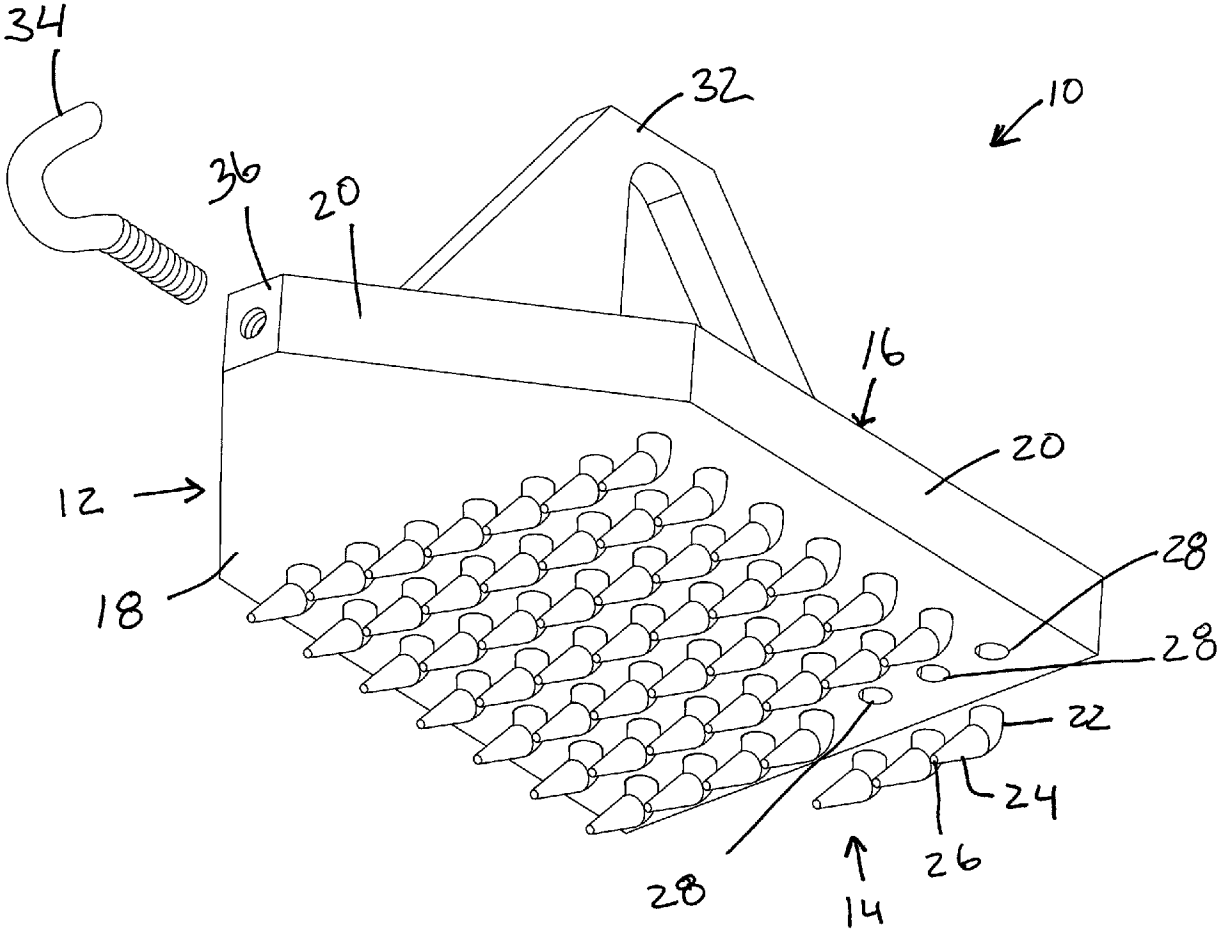
FIG. 1 is a perspective view of a turf accessory placement device according to the present invention.
Figure 2:
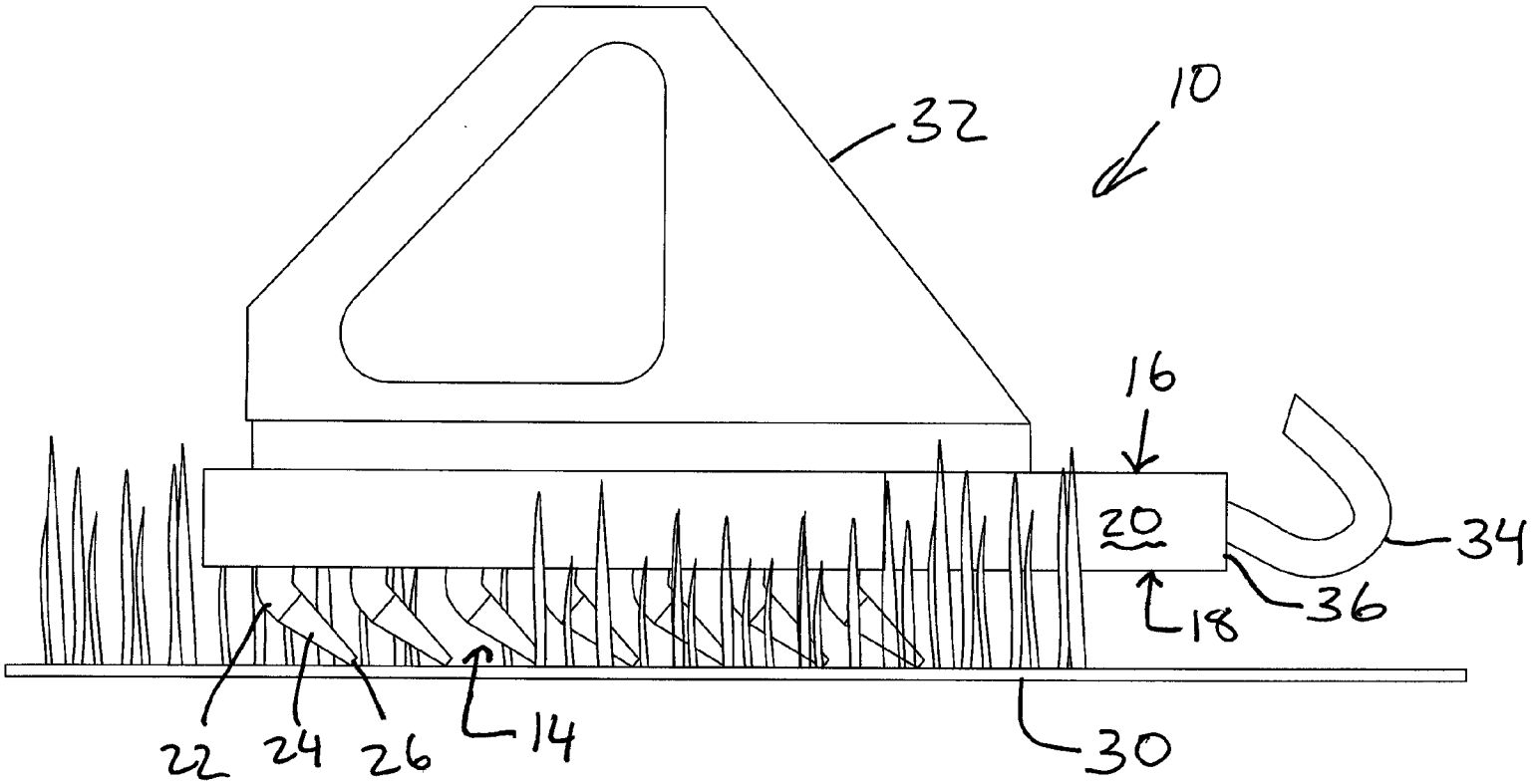
FIG. 2 is a side view of a turf accessory placement device according to the present invention.
Figure 3:
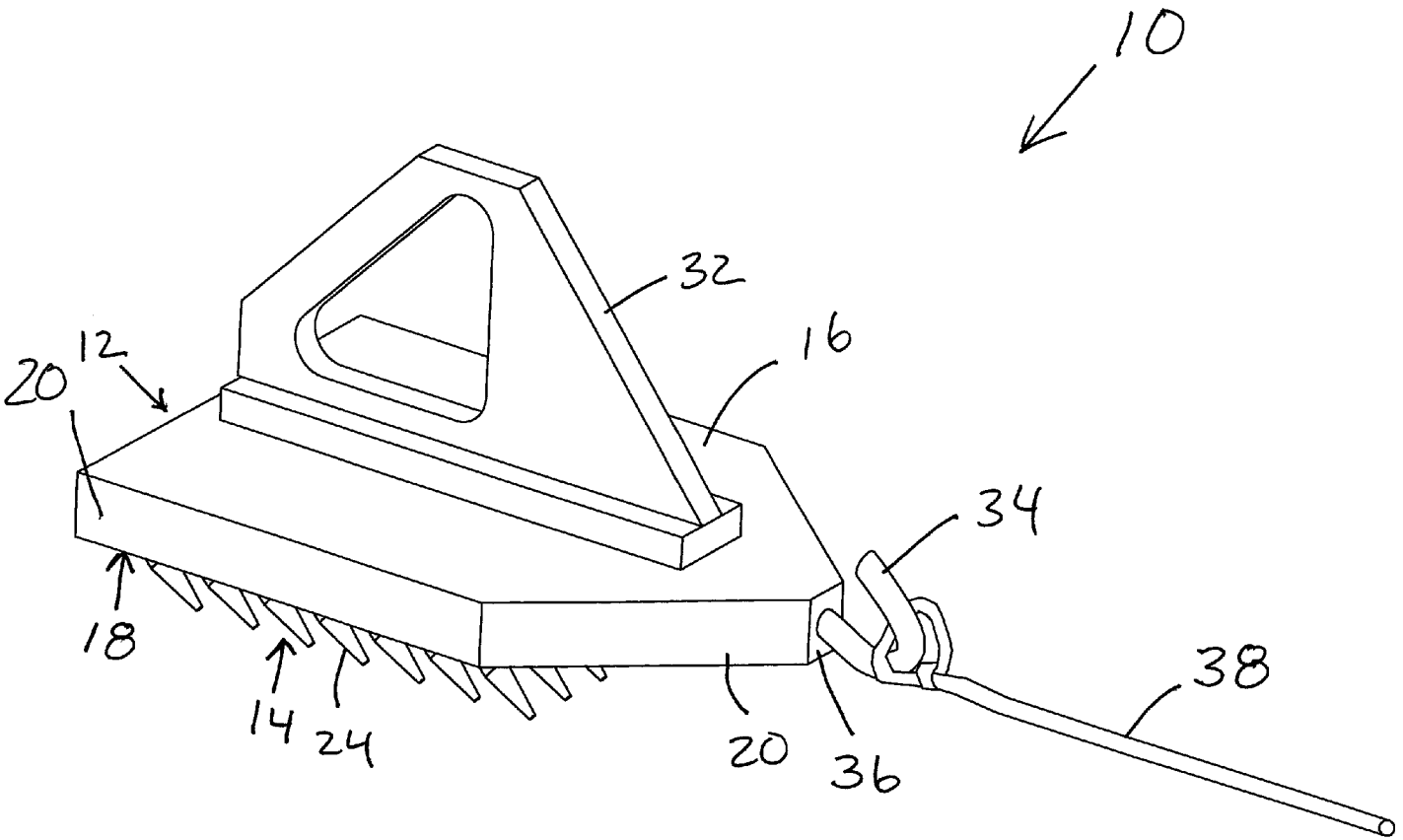
FIG. 3 is a perspective view of a turf accessory placement device according to the present invention.
Figure 4:
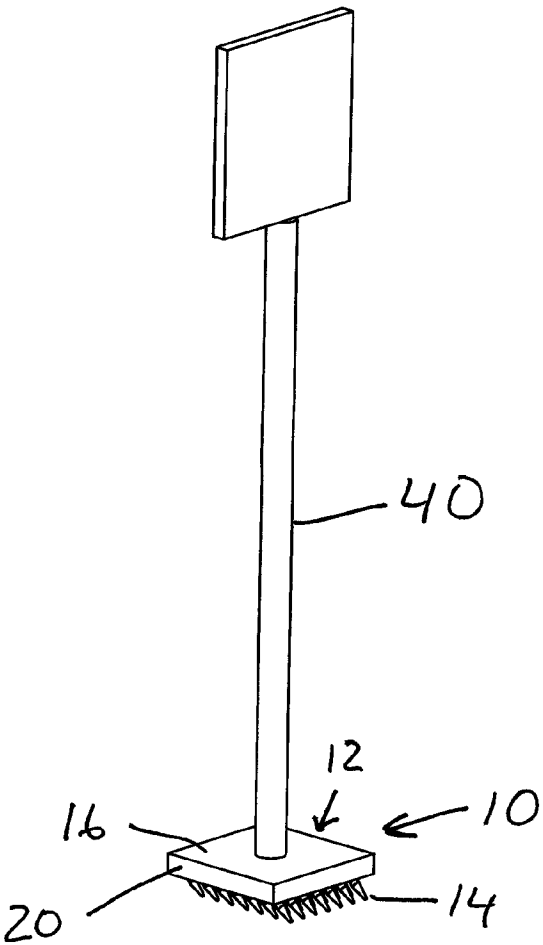
FIG. 4 is a perspective view of a turf accessory placement device according to the present invention.

The present invention is a turf accessory placement device 10, as shown in FIGS. 1-4. FIGS. 1-3 show a first embodiment and FIG. 4 shows a second embodiment of the turf accessory placement device 10. All embodiments of the turf accessory placement device 10 include a base 12 and grip spikes 14. Field turf will be used as an example, but it is envisioned that the turf accessory placement device 10 can be used with other artificial turfs as well as grass surfaces. The base 12 is used as a support. The base 12 is also used for grip spike attachment. The base 12 can be of any size and shape, depending on the purpose of used of the turf accessory placement device 10. The base 12 includes a top 16, bottom 18 and sides 20 between the top 16 and bottom 18. The grip spikes 14 each include a base attachment barrel 22 and spike shank 24 projecting from the attachment barrel 22, as shown in FIG. 1. As shown in FIGS. 1-2, the spike shank 24 of the grip spikes 14 projects off on an angle from the attachment barrel 22. The spike shank 24 has a cone shaped tip 26. FIG. 1 shows three holes 28 of a multiple of holes in the bottom 18 of the base 12. The holes 28 are used to receive the attachment barrel 22 of each grip spike 14. The attachment barrel 22 can be glued or pressed into the holes 28 of the base 12. Notice that the grip spikes 14 all project in the same direction from the base 12. It is also envisioned that the grip spikes 14 can be molded or formed as part of the base 12 during manufacture of the base 12, with or without the attachment barrel 22.

FIG. 2 shows the turf accessory placement device 10 placed on to the field turf 30, whereby, the rubber particles are not shown for clarity. The grip spikes 14 grip the blades and rubber particles, without penetrating the weave layer. The grip spikes 14 do not penetrate the weave layer due to the angle of that the spike shanks 24 project from the base 12. If the grip spikes 14 where pointing straight down from the base 12, the grip spikes 14 would not provide sufficient adhesion to the field turf 30 without penetrating the weave layer. The rubber particles (not shown) get compressed between the grip spikes 14 and the base 12 and between the grip spikes 14 and the weave layer. The compressed rubber particles push against the rubber particles around the area of the base 12. The friction action of the rubber particles caught with in the area of the base 12 and the rubber particles outside the area of the base 12 aids in holding the turf accessory placement device 10 in place. The angle of the spike shank 24 is between ninety degree and one-hundred-eighty degrees from the axis of the attachment barrel 22, which points downward from the base 12. This angle can also be characterized as zero to ninety degrees downward from the plane of the bottom 18 of the base 12. The optimum angle of the spike shank 24 is between forty and fifty degrees downward from a plane above the weave layer which is parallel to the plane of the weave layer and the plane of the bottom 18 of the base 12. The angle would be measured from the tip 26 of the spike shank 24 along a line that intersects with the plane of the bottom 18 of the base 12. The angle of the spike shank 24 allows the use of a base 12 which is relatively light in weight, as a weighted base would tend to drive the spike shanks 24 into the weave layer.

The first embodiment shows the base 12 with a handle 32 and a hook 34, as shown in FIGS. 1-3. The handle 32 is attached on top 16 of the base 12. The base 12 is shown as a rectangle with a triangle projecting from one end of the rectangle. The hook 34 is an attachment to the base 12 that projects from the tip end 36 of the triangle. The handle 32 is aligned with the tip end 36 of the triangle and the hook 34. The hook 34 projects out in the same direction as the spike shanks 24. A string line 38 can be attached to the hook 34 to use for guidance of lining the artificial turf, as shown in FIG. 3. Since the hook 34 projects in the same direction as the spike shanks 24, the force of tension on the string line 38 pulls on the base 12 and interlocks the grip spikes 14 with the blades of artificial turf and rubber particles. The interlocking of the grip spikes 14 with the blades and rubber particles holds the base 12 in place, while the string line 38 is used. Notice that the handle 32 is inline with the hook 34 and in the center of the base 12. The position of the handle 32 aids in aligned placement of the hook 34 of the turf accessory placement device 10 prior to attachment of the string line 38.

The second embodiment of the turf accessory placement device 10 allows for structural accessories on an artificial turf surface. It is known to use indoor arenas with an artificial turf surface for events other than sporting events. One example of a structural accessory is a sign. FIG. 4 shows a pole 40 extending upward from the base 12. The pole 40 allows for attachment of a sign or other items to use during an event on the artificial turf surface. The additional items added to the base 12 should be heavy enough to add some weight to hold the base 12 in place and light enough to avoid penetrating the weave layer.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A turf accessory placement device adapted for use with turf, comprising:

a base, said base having a top, bottom and sides between said top and bottom; and grip spikes extending from said bottom of said base which are adapted to grip the turf, said grip spikes each include a base attachment barrel attached to said base such said base attachment barrel projects outward from said base and having an unthreaded portion of said attachment barrel protruding straight down from said bottom of said base, said grip spikes having spike shanks projecting from said attachment barrel in the same direction at an angle between one degree and eighty-eight degrees downward from a plane along said bottom of said base to prevent damage to the turf and whereby said grip spikes all point in said same direction at said same angle to allow for said base to be pulled under tension from said direction that said grip spikes point without the base being pulled from the turf and without damage to the turf.

2. The turf accessory placement device as claimed in claim 1, wherein said grip spikes are formed as part of said base as one piece.

3. The turf accessory placement device as claimed in claim 2, further including a handle attached to said top of said base.

4. The turf accessory placement device as claimed in claim 2, further including an attachment projecting from said base that is adapted to hold a string line.

5. The turf accessory placement device as claimed in claim 2, further including a structural accessory attached to said top of said base.

6. The turf accessory placement device as claimed in claim 1, further including a handle attached to said top of said base.

7. The turf accessory placement device as claimed in claim 1, further including an attachment projecting from said base that is adapted to hold a string line.

8. The turf accessory placement device as claimed in claim 1, further including a structural accessory attached to said top of said base.

9. The turf accessory placement device as claimed in claim 8, wherein said structural accessory is a sign.

10. The turf accessory placement device as claimed in claim 8, wherein said structural accessory is a pole.

11. The turf accessory placement device as claimed in claim 1, wherein said spike shanks project from said base in the same direction at an angle between forty degrees and fifty degrees downward from a plane along said bottom of said base.

12. The turf accessory placement device as claimed in claim 1, wherein said grip spikes are adapted to interact with rubber particle and artificial grass blades of the turf, such that said grip spikes do not penetrate a weave layer of the turf.

* * * * *